US005504494A

United States Patent [19]

Chatzipetros et al.

[11] Patent Number: 5,504,494

[45] Date of Patent: Apr. 2, 1996

[54] MULTI-STAGE ANTENNA

[75] Inventors: Argyrios A. Chatzipetros, Plantation; Karl R. Guppy, Lantana; Sybren D. Smith, Plantation, all of Fla.

[73] Assignee: Motorola, Inc., Schaumburg, Ill.

[21] Appl. No.: 345,041

[22] Filed: Nov. 25, 1994

[51] Int. Cl.[6] ..... H01Q 1/10

[52] U.S. Cl. ..... 343/702; 343/895; 343/900; 343/901

[58] Field of Search ..... 343/702, 895, 343/900, 901

[56] References Cited

U.S. PATENT DOCUMENTS

| | | | |
|---|---|---|---|
| 4,725,845 | 2/1988 | Phillips | 343/702 |
| 4,868,576 | 9/1989 | Johnson, Jr. | 353/702 |
| 5,204,687 | 4/1993 | Elliott et al. | 343/702 |
| 5,343,213 | 8/1994 | Kottke et al. | 343/702 |
| 5,353,036 | 10/1994 | Baldry | 343/702 |
| 5,426,440 | 6/1995 | Shimada et al. | 343/702 X |
| 5,434,582 | 7/1995 | Koike et al. | 343/702 |
| 5,438,339 | 8/1995 | Itoh et al. | 343/895 X |

*Primary Examiner*—Donald T. Hajec
*Assistant Examiner*—Tho Phan
*Attorney, Agent, or Firm*—John G. Rauch; Barbara R. Doutre

[57] ABSTRACT

An antenna system (202) provides communication capabilities in both extended and retracted positions. Antenna system (202) includes a base helical (214) that capacitively couples to a half wavelength radiator (222) in the extended position. Base helical (214) capacitively couples to a top helical (228) in the retracted position, thereby reducing case currents on the surface of the housing (206).

17 Claims, 4 Drawing Sheets

MULTI-STAGE ANTENNA

TECHNICAL FIELD

This invention relates in general to antennas and more specifically to antennas for portable communication devices.

BACKGROUND

Many of today's personal communication systems (PCS) operate at approximately 1.9 Gigahertz (GHz). Whip antennas are generally used in the portable communication devices of PCS, such as digital European cordless telephone (DECT). FIG. 1 of the accompanying drawings shows a partial cross sectional view of a prior art communication device 100 having a typical whip antenna 102. Included within the whip antenna 102 are half wavelength radiator 104 and base helical 106. The base helix 106 is electrically connected to a transceiver board (not shown) located within the radio housing 108 and capacitively coupled to the half wavelength parasitic 104. Two non conductive portions or gaps 110, 112 exist at either end of the half wavelength radiator 104. These non conductive portions 110, 112 are typically formed of plastic material. Half wavelength parasitic 104 and non conductive portions 110, 112 are usually overmolded with plastic forming an extendible and retractable radiator portion 114. The top non conductive portion 112 aligns with the base helix 106 when the radiator 114 is in the retracted position, thereby preventing the antenna 102 from becoming detuned. In the retracted position, the only portion of the antenna acting as a radiator is the base helix 106. The performance of the prior art communication device 100 with the radiator portion 114 in the retracted position and using only the base helix 106 is greatly degraded.

The typical half wavelength parasitic 104 including the surrounding plastic molding may be 6 centimeters long at frequencies of 1.9 GHz. Even though this is an effective radiator in free space, problems can arise when the extendible radiator portion 114 of whip antenna 102 is retracted into the housing. The only radiating part then becomes the base helix 106 which is normally short and in very close proximity to internal ground shields (not shown). These ground shields encase the transceiver and are located next to the internal surface of the housing 108. The signals received or transmitted at the base helix 106 create antenna currents across the shields (also known as case currents) next to the housing. The radiation performance in this situation is poor due to the case currents not being in phase within the base helix 106 currents. When the communication device 100 is in use, the housing 108 is substantially enclosed in the operator's hand resulting in a substantial reduction in radiation efficiency.

Since users of PCS devices typically carry the device in a pocket or carry case, they tend to carry the device with the antenna in the retracted position. This however, forces the user to extend the antenna every time he wishes to use the device or keep the antenna extended at all times. Hence, there is a need for an antenna configuration that allows user to use the PCS communication device without having to extend the antenna.

DETAILED DESCRIPTION OF THE PREFERRED EMBODIMENT

Figure 1:
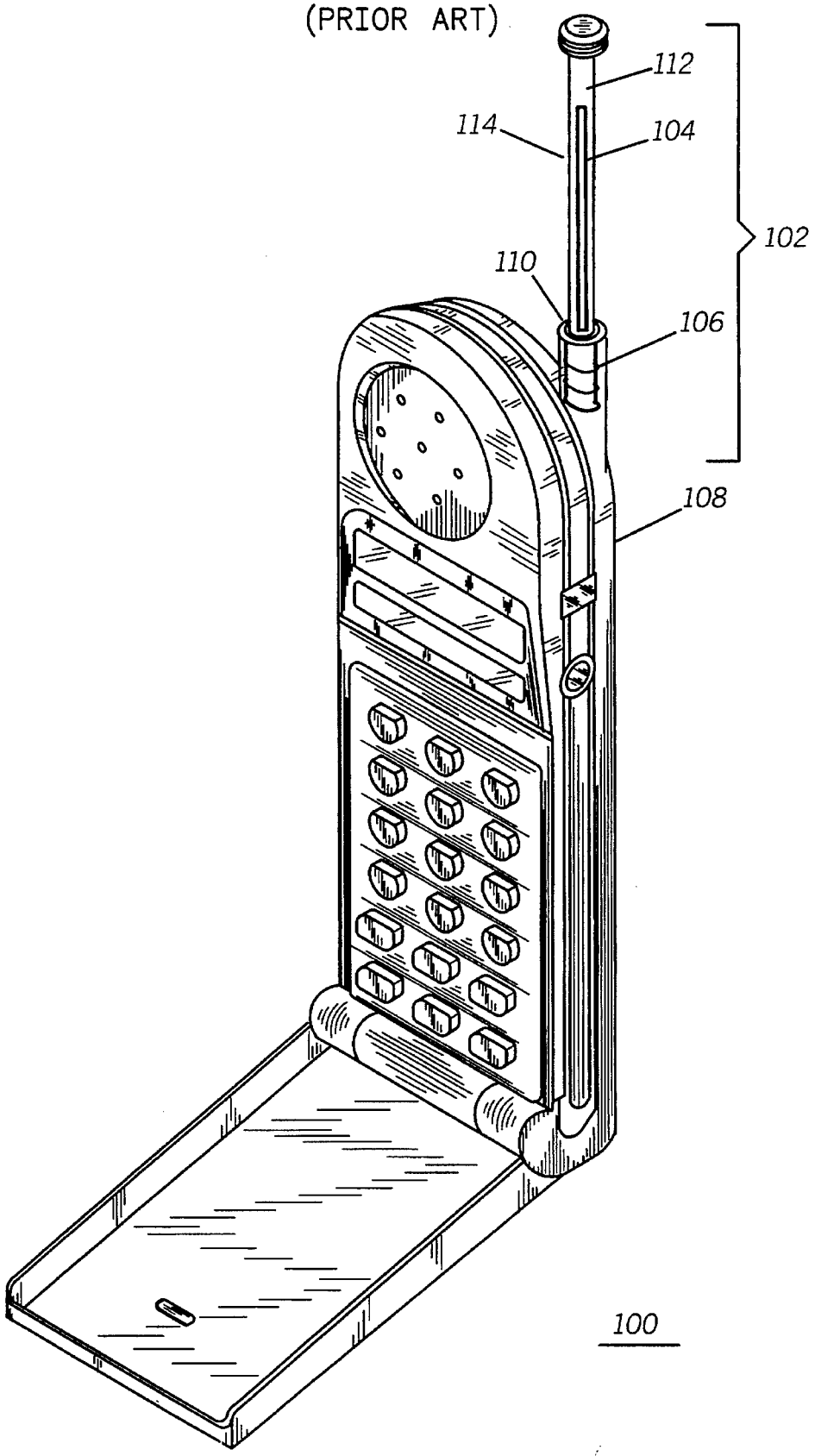
FIG.1 (PRIOR ART)
FIG. 1 is a prior art drawing of a communication device.
Figure 2:
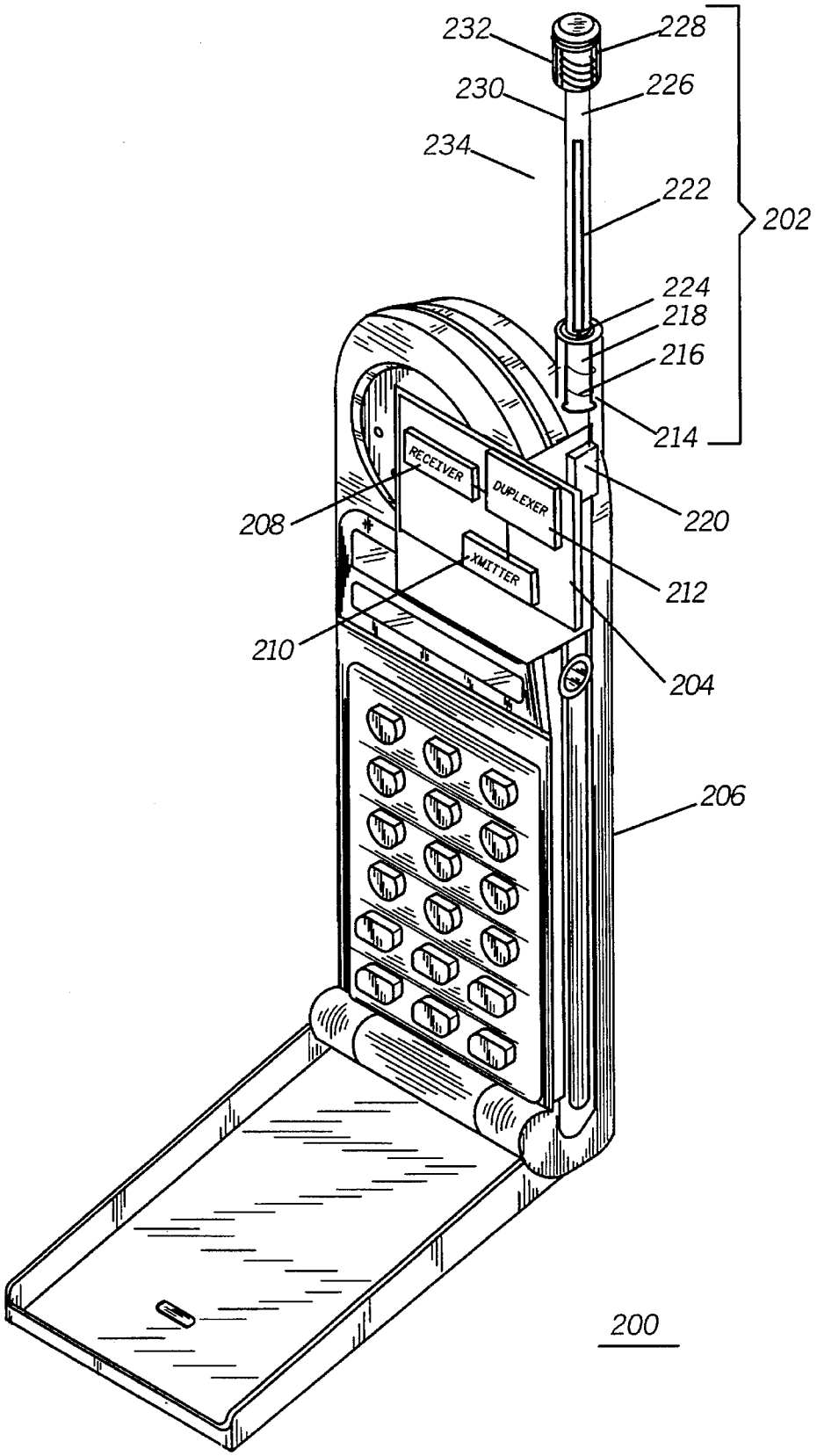
FIG. 2 is a drawing of a communication device including an antenna system in accordance with the present invention.

Referring now to FIG. 2 of the accompanying drawings there is shown a partial cross sectional view of communication device 200 including an antenna system 202 in accordance with the present invention. The antenna system 202 comprises a multi-stage antenna for a radio transceiver board 204 enclosed in a housing 206. The radio transceiver board 204 includes a receiver 208 section and transmitter section 210 coupled to a duplexer 212. Ground shields (not shown) are coupled over the transceiver.

The communication device 200 may be any personal communication systems (PCS) device operating at or above the microwave frequency range, such as digital European cordless telephone (DECT) or Japan Handy Phone (JHP). In the preferred embodiment, the antenna system 202 of the present invention is used in a DECT handset for transmitting and receiving signals in the frequency range of 1.8–2.1 GHz. During use, the operator typically holds the handset 200 in his hand once dialing of the desired telephone number is completed or to answer an incoming telephone call.

Antenna system 202 is shown in an extended position and includes a first helix 214 enclosed within housing 206. A first helix, also referred to as base helix 214, includes a helical winding 216 having first and second ends wrapped around a non conductive spool 218 that preferably snaps into housing 206. The first end of said helical winding is extended downward beyond the spool where it is then coupled to duplexer 212, preferably through radio frequency (RF) connector 220 or other RF connection means.

Antenna system 202 also comprises an extendible radiator portion 234. The spool 218 in conjunction with the extendible portion 234 include engaging/disengaging means, such as indentations and teeth (not shown), that allow the extendible portion 234 to slide into and out of the first helix 214, thus providing the user with tactile feedback indicating that the extendible portion 234 is fully retracted or extended. Extendible radiator portion 234 can also be referred to as retractable portion 234.

The extendible radiator portion 234 includes a half wavelength parasitic 222, a second helix 228, and first and second non conductive portions 224, 226 respectively, all preferably integrated within plastic casing 230. The half wavelength parasitic 222 may comprise a coiled metallic conductor or helix 223. The first non conductive portion 224 aligns with the base helix 214 such that the half wavelength parasitic 222 capacitively couples to the base helix when the extendible portion 234 is in the extended position.

The second non conductive portion 226 disposed at the top end of the half wavelength parasitic 222 has a length such that when the extendible portion 234 is retracted, the top non conductive portion 226 aligns with the base helix 214 so as not to detune the base helix. Both the first and second non conductive portions 224, 226 are preferably made of plastic and molded as part of the plastic casing 230, but other non conductive material can be used as well.

Disposed at the top end of the extendible portion 234 and above the second non conductive portion 226 is the second helix 228 formed from a helical winding 232 having first and second ends. The top end of extendible portion 234 is preferably molded to a circumference that is substantially similar to that of the base helix 214, thus allowing optimum capacitive coupling between the two helixes 214 and 228 when the extendible portion 234 is retracted. A non conductive cover or cap can be formed or molded over the top helix 228. While in the extended position, the top helix 228 couples to the half wavelength parasitic 222 creating a more effective radiator by moving antenna currents up and farther away from the housing. This improves the overall antenna performance as will be described in the graphs to follow.

Figure 3:
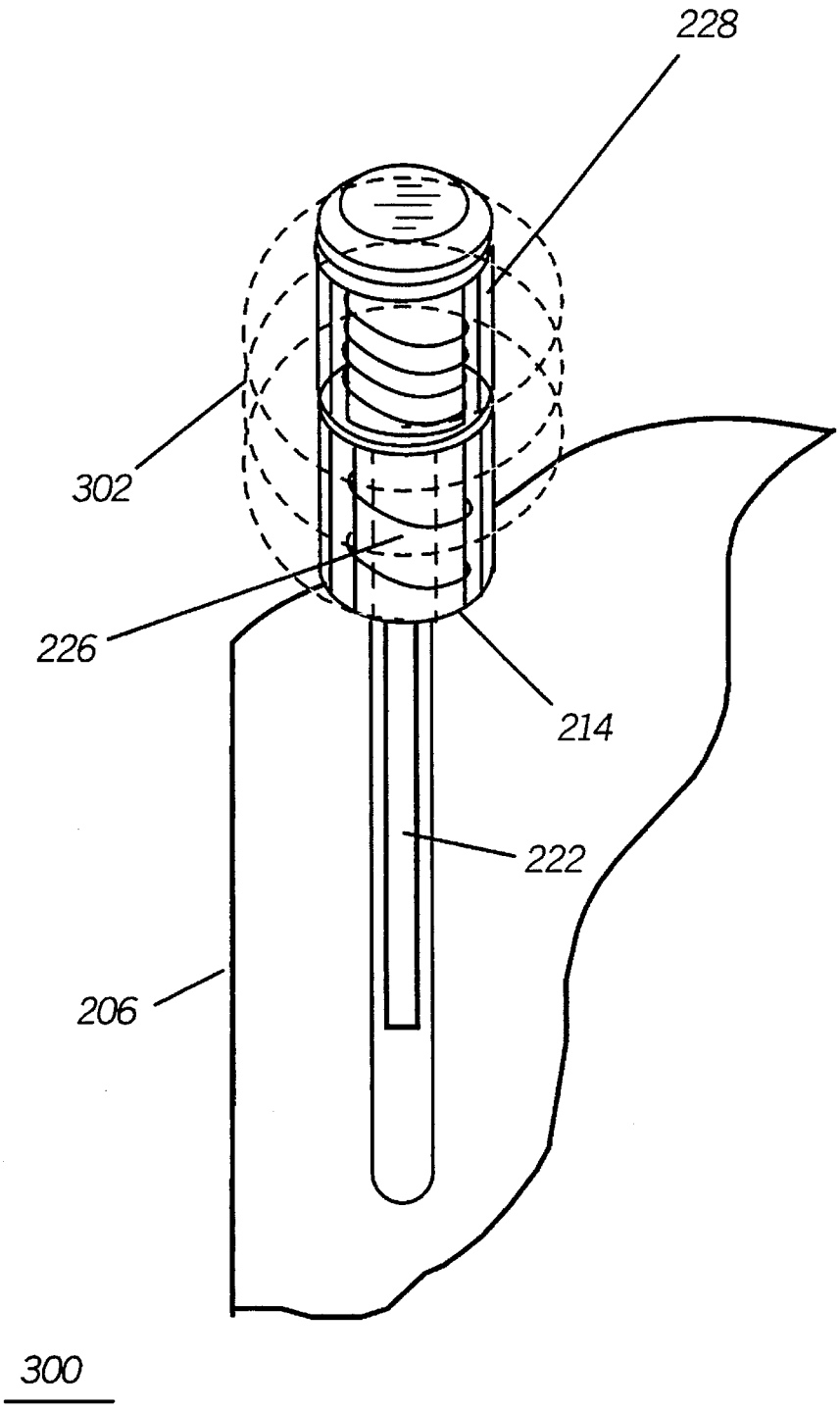
FIG. 3 shows the antenna system of FIG. 2 in the retracted position.

A further benefit of the multi stage antenna 202 as described by the invention occurs when the extendible radiator portion 234 is retracted within housing 206 as shown in FIG. 3. As previously mentioned the second non conductive portion 226 aligns within the base helix 214 so that the half wavelength parasitic 222 does not detune the base helix. The top helix 228 and the half wavelength parasitic 222 are substantially decoupled in this retracted position. Top helix 228 capacitively couples to the base helix 214 when in the retracted position thereby coupling the half wavelength top helix 228 to the quarter wavelength base helix 214. This retracted antenna configuration 300 diverts the antenna currents to an area about the top helix 228 thereby providing minimum case currents across the housing 206. These antenna currents are represented by signals 302. By reducing the case currents, a more efficient antenna is provided to the communication device. Hence, a user that is holding the housing while engaged in a call will not be as likely to detune the antenna while the antenna is in the retracted position.

In the preferred embodiment, the overall length of the antenna system measures approximately 10 cm in the extended position and measures approximately 3 cm in the retracted position. The base helix is preferably comprised of 2 windings of beryllium copper (BeCu) forming a substantially quarter wavelength radiator. The top helix 228 is preferably comprised of 4 windings of BeCu forming a substantially half wavelength radiator. The half wavelength parasitic 222 is preferably comprised of 6 cm titanium nickel.

While the best overall performance is still available in the extended position, the antenna system as described by the invention allows the user to make or receive calls without extending the antenna. This can be also a benefit when the user is perhaps in a hurry or wishes to be less conspicuous while using the communication device in public.

Figure 4:
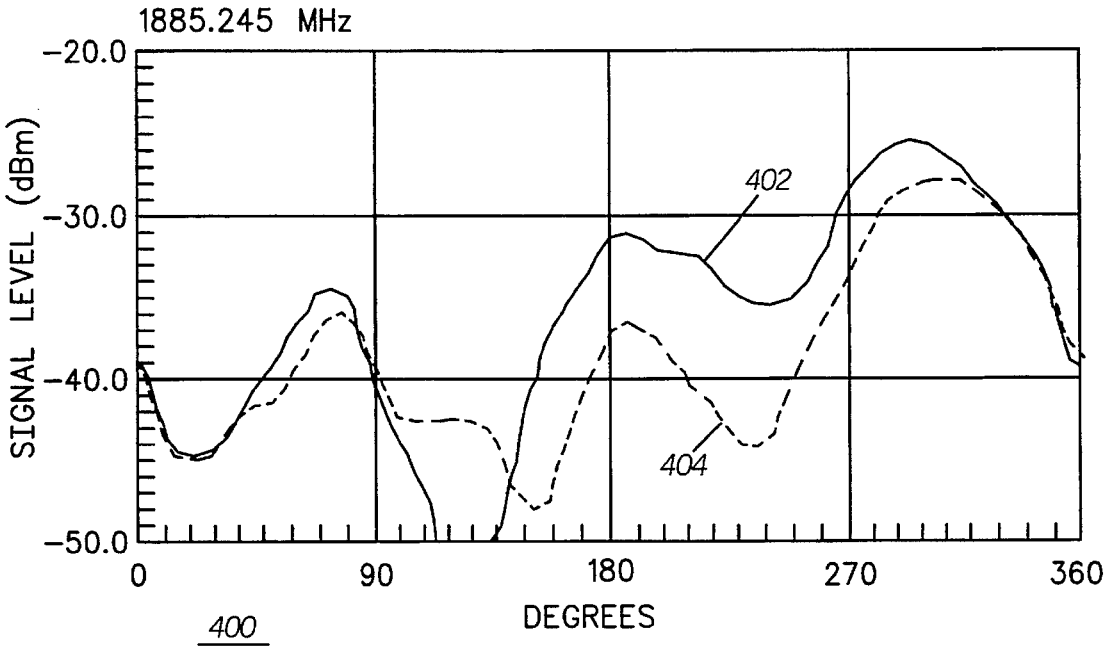
FIG. 4 is a graph of the antenna performance of the present invention in an extended position.

FIG. 4 of the accompanying drawings shows a graph comparing the transmitted signal strength levels of a communication device employing the prior art antenna in the extended position to the same communication device employing the multi-stage antenna as described by the invention in the extended position. This transmitting pattern is the same as the receiving pattern. Graph 400 compares the signal levels in decibels relative to 1 milliwatt (dBm) transmitted by the antenna while the user is holding the communication device next to his head and is rotated over a 360 degree radius. Line 402 represents the antenna as described by the invention, while line 404 represents the prior art antenna. The measured average signal level received with the prior art antenna was −34.9 dBm at a frequency of approximately 1.9 GHz while the average signal level received with the antenna as described by the invention was −32.9 dBm. Hence, the antenna as described by the invention improve the overall performance while in the extended position by approximately 2 dB.

Figure 5:
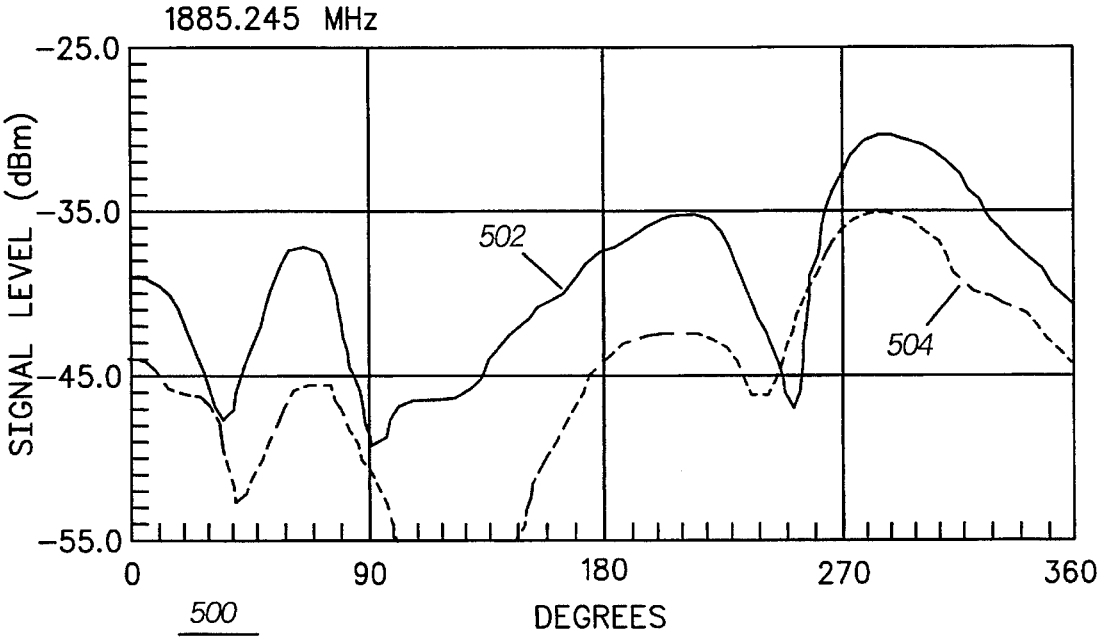
FIG. 5 is a graph of the antenna performance of the present invention in a retracted position.

FIG. 5 is a graph comparing the transmitted signal strength levels of the communication device employing the prior art antenna in the retracted position to the same communication device employing the multistage antenna as described by the invention in the retracted position. Graph 500 compares the signal level in dBm received at the antenna while a user holding the communication device next to his head is rotated over a 360 degree radius. Line 502 represents the antenna as described by the invention while line 504 represents the prior art antenna. The average measured signal level received with the prior art antenna was −41.5 dBm while the received signal level with the antenna as described by the invention was −36.7 dBm. Hence, an overall improvement of approximately 4 to 5 dB was observed using the antenna as described by the invention.

The antenna system as described by the invention is readily adaptable to radios operating in the microwave frequency range where the size of the top helical can be kept small enough so as not to encumber the user when carrying the portable with the antenna in the retracted position. Moreover, the antenna structure can be tuned to lower frequencies by varying the number of windings. Existing communication devices that include a base helix can be retrofitted with the present invention for improved performance.

While the preferred embodiments of the invention have been illustrated and described, it will be clear that the invention is not so limited. For example, the base helix is described as having an electrical length of a quarter wavelength but can work equally well with other electrical lengths such as a ⅓ wavelength that can still be enclosed or configured within the housing. The half wavelength parasitic while shown as a wire conductor or stripline of titanium nickel can also take on other configurations such as a coil of beryllium copper. Numerous modifications, changes, variations, substitutions and equivalents will occur to those skilled in the art without departing from the spirit and scope of the present invention as defined by the appended claims.

Hence, the antenna system as described by the invention provides a means for reducing case currents when in the retracted position as well as the extended position. The benefits derived from using such an antenna system in a portable communication device include allowing the user make, receive, and maintain calls without being required to extend the antenna.

What is claimed is:

1. An antenna system for a portable radio enclosed within a housing, comprising:

a first radiator portion having a resonant frequency of operation disposed in the housing; and an extendible radiator portion including top and bottom ends, comprising:

a first non conductive portion disposed at the bottom end;

a second radiator portion including a half wavelength parasitic at the resonant frequency disposed above the first non conductive portion;

a third radiator portion disposed at the top end;

a second non conductive portion disposed between the third radiator portion and the second radiator portion;

said second radiator portion being capacitively coupled to said first radiator portion and said third radiator portion when said extendible radiator portion is extended; and said first radiator portion and said third radiator portion being capacitively coupled when said extendible radiator portion is retracted, the capacitive coupling being defined at said resonant frequency of operation.

2. An antenna system as described in claim 1, wherein said first radiator portion is substantially a quarter wavelength and said third radiator portion is substantially a half wavelength.

3. An antenna system as described in claim 1, wherein said second nonconductive portion aligns with said first radiator portion when said extendible radiator portion is retracted.

4. An antenna for a portable radio transceiver enclosed in a housing, the antenna configured for movement between an extended position and a retracted position, the antenna comprising:

a first helix enclosed in the housing and electrically coupled to the transceiver, the first helix having a resonant frequency of operation;

a half wavelength parasitic at the resonant frequency; and a second helix disposed on top of said half wavelength parasitic, wherein said first and second helixes are capacitively coupled when the antenna is in the retracted position, and wherein said second helix is capacitively coupled to said half wavelength parasitic and said first helix is capacitively coupled to said half wavelength parasitic when the antenna is in the extended position, the capacitive coupling being defined at said resonant frequency of operation.

5. An antenna as described in claim 4, wherein the second helix has an electrical length of substantially a half wavelength.

6. An antenna as described in claim 5, wherein the first helix has an electrical length of substantially a quarter wavelength.

7. An antenna assembly for diverting antenna currents away from a housing, in both extended and retracted positions, for a portable radio enclosed within said housing, the antenna assembly comprising:

a first radiator portion disposed within said housing, the first radiator portion having a resonant frequency of operation; and an extendible radiator portion operatively coupled to said housing and including second and third radiator portions, the second radiator portion capacitively coupling to the first radiator portion and the third radiator portion capacitively coupling to the second radiator portion when in the extended position, and the third radiator portion capacitively coupling to the first radiator portion when in the retracted position, the capacitive coupling being defined at said resonant frequency of operation.

8. An antenna assembly as described on claim 7, wherein the first radiator portion comprises a quarter wavelength helix.

9. An antenna assembly as described in claim 7, wherein the second radiator portion comprises a half wavelength parasitic.

10. An antenna assembly as described in claim 7, wherein the third radiator portion comprises a half wavelength parasitic.

11. A portable communication device, comprising:

a transmitter portion;

a receiver portion;

a radio frequency (RF) connector;

a duplexer portion for coupling said transmitter portion and said receiver portion to the RF connector;

a housing having top and bottom portions and enclosing said transmitter portion, said receiver portion, and said duplexer portion;

an extendible antenna system comprising;

a helical antenna section disposed in the top portion of said housing and including a base helical winding having first and second ends, the first end of said base helical winding being electrically connected to the RF connector, the base helical winding having a resonant frequency of operation;

an extendible radiator section having a non conductive bottom portion, a conductive half wavelength portion, and a top section including a non conductive top portion and a top helical winding, the conductive have wavelength portion being capacitively coupled to the second end of said base helical winding when extended from said housing and being substantially decoupled therefrom when retracted into said housing; and said top helical winding being capacitively coupled to said base helical winding when said conductive half wavelength portion is retracted into said housing, the capacitive coupling being defined at said resonant frequency of operation.

12. A portable communication device as described in claim 11, wherein:

the top helical winding is capacitively coupled to said conductive half wavelength portion when said extendible radiator section is extended; and said top helical winding is substantially decoupled from said conductive half wavelength portion when said extendible radiator section is retracted.

13. A portable communication device as described in claim 11, wherein the base helical winding is substantially a quarter wavelength and the top helical winding is a half wavelength.

14. A portable communication device as described in claim 11, wherein the non conductive bottom portion has substantially the same physical length as the helical antenna section.

15. A portable communication device as described in claim 11, wherein the top and bottom non conductive portions of said extendible radiator section are plastic.

16. A portable communication device as described in claim 11, wherein the conductive half wavelength portion comprises a coiled metallic conductor.

17. A portable communication device as described in claim 11, wherein the portable communication device comprises a digital European cordless telephone.

* * * * *